US006932289B2

(12) United States Patent
Musil

(10) Patent No.: US 6,932,289 B2
(45) Date of Patent: Aug. 23, 2005

(54) DYNAMIC TRAMP IRON RELIEF SYSTEM

(75) Inventor: Joseph E. Musil, Ely, IA (US)

(73) Assignee: Cedarapids, Inc., Cedarapids, IA (US)

( * ) Notice: Subject to any disclaimer, the term of this patent is extended or adjusted under 35 U.S.C. 154(b) by 68 days.

(21) Appl. No.: 10/310,315

(22) Filed: Dec. 5, 2002

(65) Prior Publication Data

US 2003/0132328 A1 Jul. 17, 2003

Related U.S. Application Data

(60) Provisional application No. 60/347,779, filed on Jan. 11, 2002.

(51) Int. Cl.[7] ..... B02C 1/02
(52) U.S. Cl. ..... 241/264; 241/32
(58) Field of Search ..... 241/264, 265, 241/32

(56) References Cited

U.S. PATENT DOCUMENTS

| | | | | | |
|---|---|---|---|---|---|
| 607,575 | A | | 7/1898 | Musil | |
| 947,669 | A | | 1/1910 | Mitchell | |
| 1,611,128 | A | | 12/1926 | Gunnison | |
| 1,967,240 | A | | 7/1934 | Guest | 83/53 |
| 1,987,762 | A | | 1/1935 | Symons | 83/53 |
| 2,566,583 | A | | 9/1951 | Shelton | 241/217 |
| 2,588,180 | A | * | 3/1952 | Traylor, Jr. | 241/148 |
| 2,670,141 | A | | 2/1954 | Anderson | 241/140 |
| 3,315,902 | A | * | 4/1967 | Pollitz | 241/231 |
| 3,473,744 | A | | 10/1969 | De Diemar et al. | 241/219 |
| 3,656,696 | A | | 4/1972 | Mailliard | 241/155 |
| 3,938,732 | A | * | 2/1976 | Schrimper et al. | 241/231 |
| 4,783,013 | A | | 11/1988 | Polzin | 241/219 |
| 4,927,089 | A | | 5/1990 | Altmayer | 241/264 |
| 4,989,797 | A | * | 2/1991 | DeDiemar et al. | 241/264 |
| 5,111,569 | A | | 5/1992 | Ostergaard | |
| 5,660,337 | A | * | 8/1997 | Falbo et al. | 241/37 |
| 5,765,769 | A | * | 6/1998 | Kaya | 241/264 |
| 6,375,105 | B1 | * | 4/2002 | Haven et al. | 241/264 |

* cited by examiner

*Primary Examiner*—Daniel C. Crane
(74) *Attorney, Agent, or Firm*—Marshall, Gerstein & Borun LLP

(57) ABSTRACT

A jaw crusher having a dynamically adjustable tramp iron relief system is disclosed. A moveable jaw and a stationary jaw define a crushing chamber, with a lower portion of the moveable jaw cooperating with a lower portion of the stationary jaw to define a closed side setting gap. A hydraulic tramp iron relief system operatively connects at least one of the jaws to the frame and is arranged to permit uncrushable material to pass through the crushing chamber by permitting the lower portion of the jaw to shift to a shifted position in which the gap is increased. The tramp iron relief system includes an adjustable hydraulic cylinder, the hydraulic cylinder arranged to permit the gap to be adjusted during operation of the crusher.

29 Claims, 4 Drawing Sheets

DYNAMIC TRAMP IRON RELIEF SYSTEM

RELATED APPLICATIONS

This application claims priority from U.S. Provisional Application Ser. No. 60/347,779, filed Jan. 11, 2002.

FIELD OF THE INVENTION

The present invention relates to jaw crushers for crushing aggregate material and having a stationary crushing jaw and a moveable crushing jaw. More specifically, the present invention relates to a tramp iron relief system for such jaw crushers.

BACKGROUND OF THE INVENTION

A typical jaw crusher includes a stationary jaw and a moveable jaw which are spaced apart to define a crushing chamber there between. Aggregate material is fed into the crushing chamber and is crushed by cooperating surfaces on each of the jaws as the moveable jaw repeatedly reciprocates toward and away from the stationary jaw in a well known fashion.

The size of the aggregate produced by the jaw crusher is largely determined by the closed side setting, which essentially is the distance between the lower-most edge of the jaws. Relatively large pieces of aggregate are fed into the top of the crushing chamber, and the material is gradually crushed by the reciprocating jaws as the material falls lower and lower into the crushing chamber. Once the material has reached the desired size (i.e., smaller than the closed side setting), the material falls out of the crushing chamber and is carried away in a conventional manner.

Occasionally, however, the aggregate material being fed into the crushing chamber will include uncrushable material, commonly referred to as "tramp iron." As is known, tramp iron hinders or stops the crushing operation, and in some circumstances the tramp iron causes serious damage to one or more components of the jaw crusher.

Tramp iron relief systems have been developed in order to address this problem. From an operational standpoint, existing tramp iron relief systems suffer from one or more drawbacks. Thus, there is a continuing need for improvements in tramp iron relief systems for jaw crushers.

DETAILED DESCRIPTION OF THE PREFERRED EMBODIMENT

The embodiment(s) described herein are not intended to be exhaustive or to limit the scope of the invention to the precise form or forms disclosed. The following embodiment (s) have been chosen and described in order to best explain the principles of the invention and to enable others skilled in the art to follow its teachings.

Figure 1:
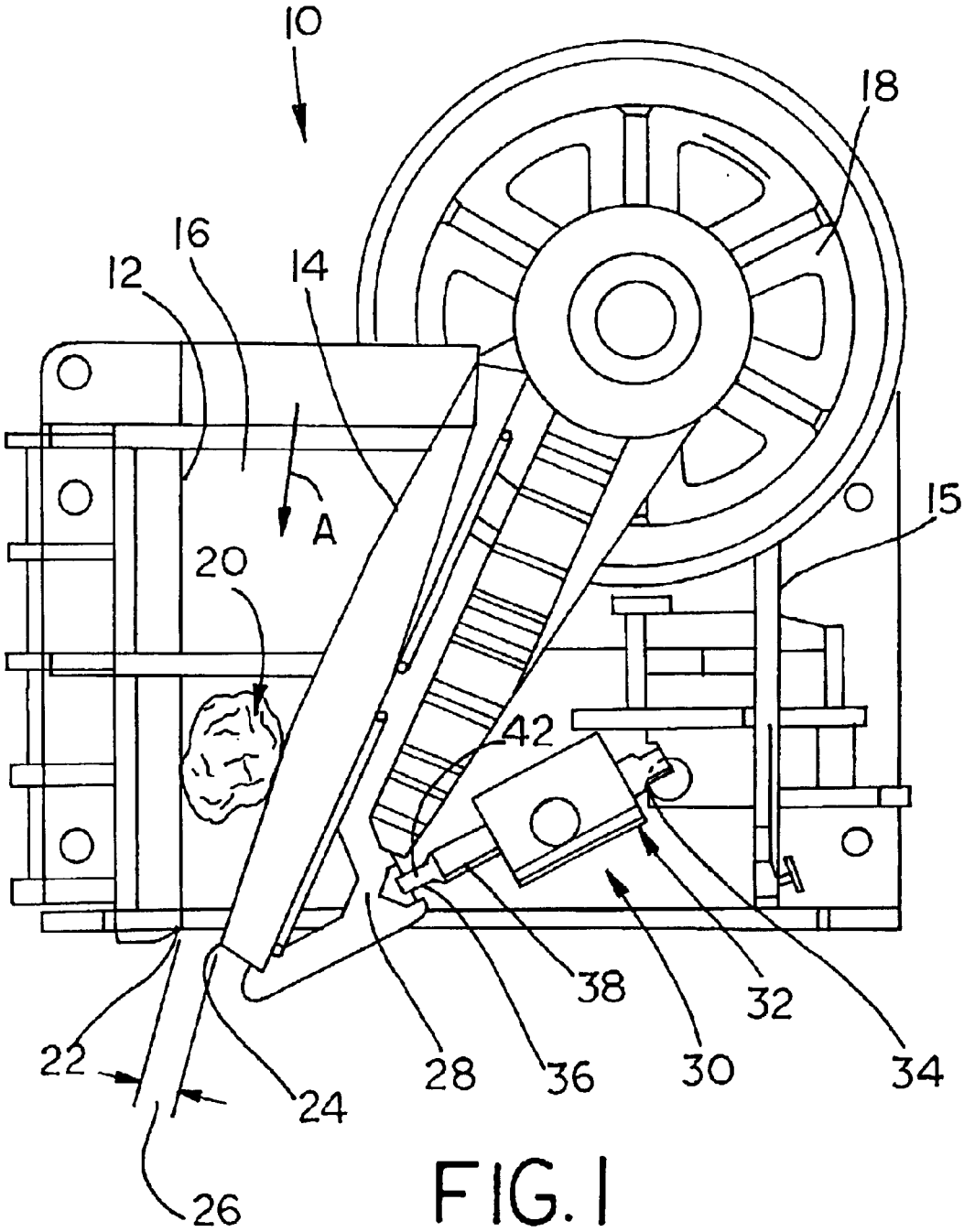
FIG. 1 is a fragmentary cross-sectional view of a jaw crusher incorporating a tramp iron relief system assembled in accordance with the teachings of the present invention.

Referring now to the drawings, FIG. 1 illustrates a jaw crusher 10 of the type generally well known in the art. The jaw crusher 10 includes a stationary jaw 12 and a moveable jaw 14, which are mounted to a frame 15 and which are spaced apart to define a crushing chamber 16 between the stationary jaw 12 and the moveable jaw 14. The jaw crusher 10 also includes a drive system 18 of the type generally well known in the art and which is adapted to reciprocate the moveable jaw 14 back and forth relative to the stationary jaw 12 so as to crush aggregate material fed into the crushing chamber 16 by a conventional feed system (not shown) generally along a material flow path A. As is known, the aggregate material 20 disposed in the crushing chamber 16 will be crushed by opposing sets of teeth (not shown) on the stationary jaw 12 and the moveable jaw 14, due to the repetitive back and forth movement of the moveable jaw 14 relative to the stationary jaw 12. The jaw crusher 10 will also includes a variety of other system components (not shown), all of which are known to those skilled in the art.

The stationary jaw 12 includes a lower portion 22, while the moveable jaw 14 includes a lower portion 24. The lower portion 22 and the lower portion 24 cooperate to define a gap 26 adjacent the lower end of the crushing chamber 16. The gap 26 is commonly referred to as the closed side setting.

The moveable jaw 14 is attached to a suitable mounting frame 28 of the type commonly employed in the art. The mounting frame 28 is operatively connected to the frame of the jaw crusher 10 by a dynamically adjustable tramp iron relief system 30 assembled in accordance with the teachings of the present invention. The tramp iron relief system 30 includes a hydraulic cylinder 32 having a first end 34 mounted to the frame 15, such as by a conventional toggle assembly, and a second end 36 mounted to the mounting frame 28, again by a conventional toggle assembly.

In the embodiment shown, the second end 36 is formed by a piston rod 38. The piston rod 38 includes a first end 40 disposed within the hydraulic cylinder 32 (FIGS. 3 through 5), and a second end 42 which is connected to the mounting frame 28 by the conventional toggle assembly referred to above. It will be understood that during the operation of the jaw crusher 10, uncrushable material (not shown) occasionally enters the crushing chamber 16. The tramp iron relief system 30 enables the uncrushable material to pass through the crushing chamber 16 by permitting the moveable jaw 14 to shift from the normal, unshifted position indicated in FIG. 1 (and indicated in dotted lines in FIG. 2), to a shifted position indicated in FIG. 2. The tramp iron relief system 30 will also return the moveable jaw 14 to the unshifted position after the uncrushable material has exited the crushing chamber 16.

Figure 3:
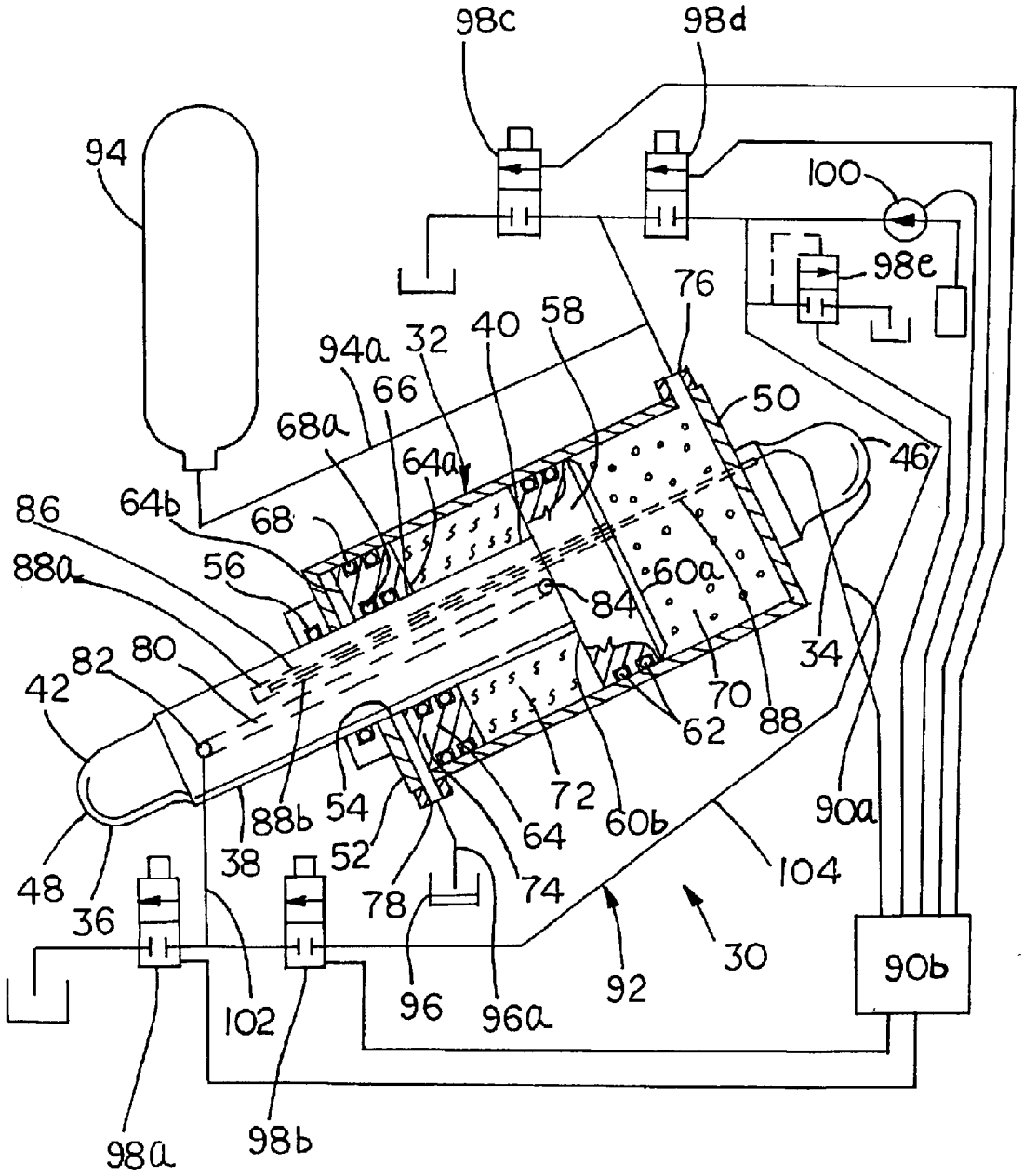
FIG. 3 is a schematic diagram of a tramp iron relief system assembled in accordance with the teachings of the present invention.

Referring now to FIG. 3, the tramp iron relief system 30 assembled in accordance with the disclosed example is shown. The first end 34 of the hydraulic cylinder 32 includes a fitting 46 which is sized and shaped to fit into the conventional toggle seat on the frame 15 in a known manner. The second end 36 of the hydraulic cylinder 32 also includes a fitting 48 which is sized and shaped to fit within a conventional toggle seat on the mounting frame 28. The first end 34 of the hydraulic cylinder includes an end cap 50, while the second end 36 of the hydraulic cylinder 32 includes an end cap 52. The piston rod 36 extends through an aperture 54 in the end cap 52, with the aperture 54 preferably being provided with a suitable seal 56. A piston 58 is mounted to the first end 40 of the piston rod 38. The piston 58 includes a face 60*a* and a face 60*b*. The piston 58 preferably is provided with a suitable seal 62.

A second piston 64 is also disposed within the hydraulic cylinder 32. The piston 64 includes an aperture 66 sized to slidably receive the piston rod 38, such that the position of the piston 64 relative to the piston rod 38 may be adjusted as will be explained in greater detail below. The piston 64 includes a face 64*a* and a face 64*b*. Preferably, the aperture 66 is provided with a suitable seal 68*a*, while the outside of the piston 64 is provided with a suitable seal 68*b*. The pistons 58 and 64, along with the end caps 50, 52, thus cooperate to define within the hydraulic cylinder 32 a first cavity 70, and second cavity 72, and a third cavity 74. More specifically, the face 60*a* of the piston 58 cooperates with the end cap 50 to define the cavity 70, the face 64*a* of the piston 64 cooperates with the face 60*b* of the piston 58 to define the cavity 72, and the face 64*b* of the piston 64 cooperates with the end cap 52 to define the cavity 74. It will be noted that the piston 58 is fixed with respect to the first end 40 of the piston rod 38, while the piston 64 is slidable with respect to the piston rod 38.

The hydraulic cylinder 32 also includes a port 76 and a port 78. The port 76 is in flow communication with the first cavity 70, while the port 78 is in flow communication with the third cavity 74. The piston rod 38 includes a bore 80 having a port 82 and a port 84. The port 82 is disposed generally adjacent the second end 42 of the piston rod 38, while the port 84 is disposed inside the hydraulic cylinder 32 (just to the left of the face 58*b* of the piston 58 when viewing FIGS. 3–5), and in flow communication with the second cavity 72. Preferably, the port 84 is disposed closely adjacent to the face 58*b* of the piston 58.

The piston rod 38 may also be provided with a second bore or groove 86, which, if provided, may be sized to receive a linear variable differential transducer 88 (LVDT). The LVDT 88 functions as a position sensor, and typically includes a primary coil 88*a* and a core 88*b*. In the disclosed example, the primary coil 88*a* is disposed within the groove 86 in the piston rod 38. The core 88*b*, which is slidably disposed within the primary coil 88*a* as is known, extends to the end cap 50. The LVDT 88 is provided with a suitable output 90, which routes a signal 90*a* to a suitable controller 90*b* having a suitable interface (not shown). The LVDT 88 thus will provide an indication of the position of the piston rod 38 within the hydraulic cylinder 32, which may then be readily converted into an indication of the size of the gap 26 between the jaws using conventional engineering and mathematical principles.

The tramp iron relief system 30 is provided with a hydraulic control circuit 92. The hydraulic control circuit 92 includes an accumulator 94 in flow communication with the port 76 via hydraulic line 94*a*. The hydraulic control circuit 92 also includes a reservoir 96 in flow communication with the port 78 via hydraulic line 96*a*. The hydraulic control circuit 92 also includes a number of valves 98*a*, 98*b*, 98*c*, 98*d*, and 98*e*. A suitable pump 100 is also provided. Suitable controls for each of the valves 98*a* through 98*e*, and for the pump 100, preferably are also provided, all of which is within the capability of those of ordinary skill in the art. The hydraulic control circuit 92 may also be provided with any number of additional reservoirs, drains, supply tanks, valves, etc., as needed as would be known to one of ordinary skill in the art.

Figure 2:
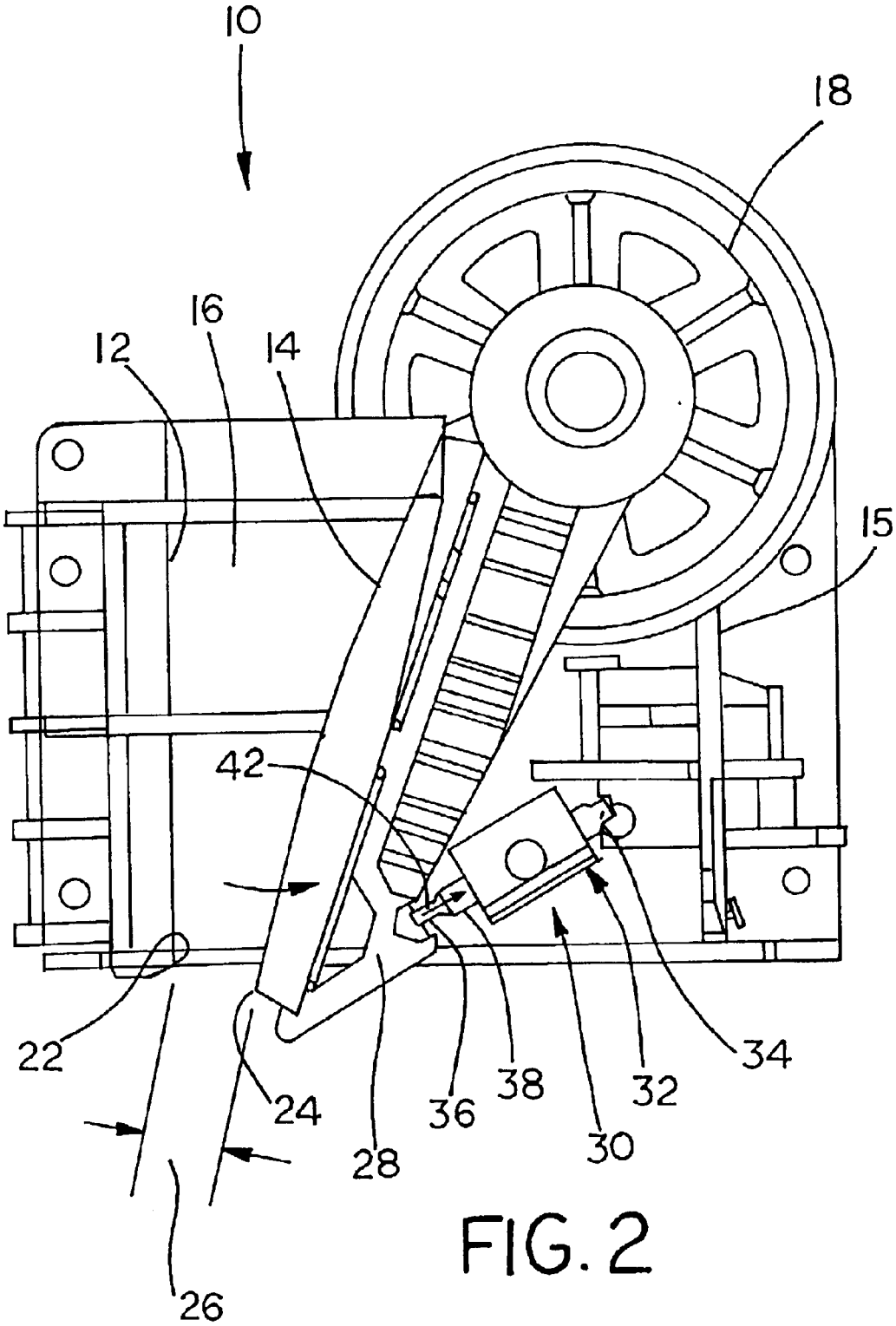
FIG. 2 is a fragmentary cross-sectional view similar to FIG. 1 but illustrating the moveable jaw shifted in response to a tramp iron event.
Figure 4:
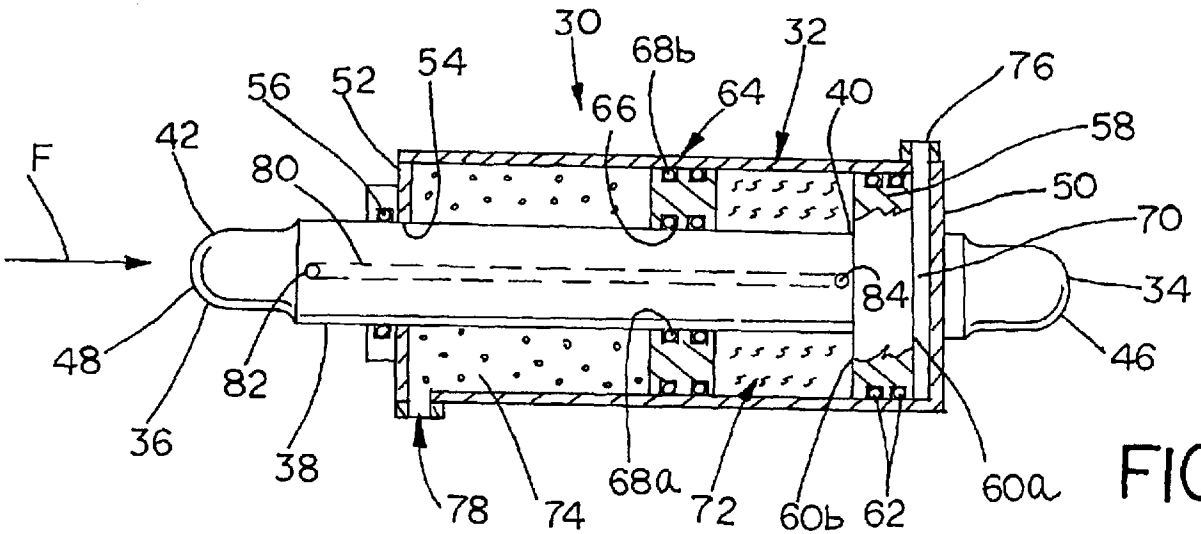
FIG. 4 is a schematic diagram similar to FIG. 3 but illustrating the trap iron relief system in a shifted position in response to a tramp iron event.
Figure 5:
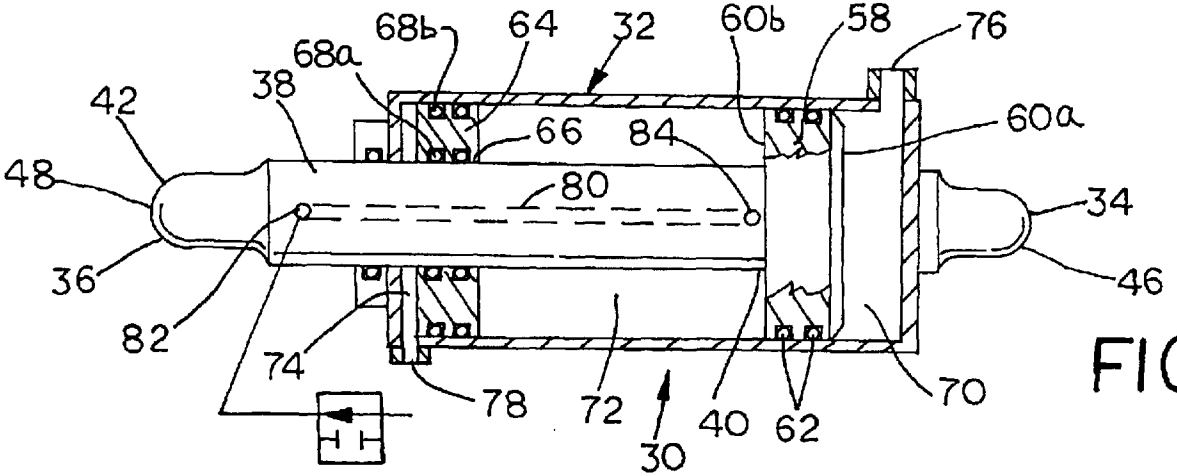
FIG. 5 is a schematic diagram similar to FIG. 3 but illustrating one possible manner by which the disclosed example may be used to adjust the closed side setting of the jaw crusher.

Referring now to FIG. 4, the tramp iron relief system 30 is shown in a shifted position, which would correspond to the movable jaw 14 being urged to the shifted position of FIG. 2 (such as would occur in response to a tramp iron event). It will be appreciate that during a tramp iron event, a force indicated by the reference arrow F will be applied to the piston rod 38 via the toggle assembly via the fitting 46, thus causing the piston rod 38 to shift toward the right when viewing FIG. 4.

When the hydraulic cylinder 32 has shifted to the position of FIG. 4, it will be appreciated that hydraulic fluid or oil in the first cavity 70 will exit via the port 76, and will flow to the accumulator 94 via the hydraulic line 94*a*. When this happens, the first cavity 70 experiences a reduction in volume. Further, in response to a tramp iron event, the third cavity 74 will experience an increase in volume, thus drawing hydraulic oil into the third cavity 74 from the reservoir 96 via the hydraulic line 96*a*.

As would be known to those of skill in the art, the accumulator 94 receives the hydraulic oil from the hydraulic cylinder 32, and maintains the hydraulic oil under suitable pressure such that the hydraulic cylinder 32 will return to the original and unshifted position of FIG. 3 after the uncrushable material has exited the crushing chamber 16. It will also be appreciated that the accumulator 94 and the hydraulic control circuit 92 in general, will be arranged such that the hydraulic oil in the first cavity 70 is maintained at a desired pressure at all times. Such a determination of the desired pressure would depend on the actual dimensions of the jaw crusher 10 and the dimensions of the hydraulic cylinder 32, and is well within those of skill in the art using well known engineering principles.

It will also be understood that as the hydraulic cylinder 32 returns to its unshifted position, the hydraulic oil in the accumulator 94 will return to the first cavity 70 via the hydraulic line 94*a* aided by the fact that the oil therein is under pressure, while at the same time the hydraulic oil in the third cavity 74 will return to the reservoir 96 via the hydraulic line 96*a*. The hydraulic oil returning to the reservoir 96 from the third cavity 74 will, in the disclosed example, prevent the piston 64 from slapping into the end cap 52. The valves 98*c* and 98*d* can be selectively activated as necessary using a suitable control system (now shown), thus enabling the pressure in the accumulator 94 and the first cavity 70 to be increased or decreased as desired, using the pump 100.

It also will be understood that during the normal operation of the tramp iron relief system 30, the relative positions of the piston 58 and the piston 64 within the hydraulic cylinder 32 will remain generally fixed. In other words, the size of the second cavity 72 will remain essentially unchanged as the hydraulic cylinder 32 responds to a tramp iron event as outlined above.

A hydraulic line 102 is suitably connected to the port 82 in the piston rod 38. The hydraulic line 102 is connected to the hydraulic pump 100 via a hydraulic line 104. By opening the valve 98*b*, hydraulic oil may be supplied to the second cavity 72 via the bore 80. The hydraulic oil enters the port 82, travels through the bore 80 in the piston rod 38, and exits the port 84, thus providing additional oil into the second cavity 72.

By this operation, the size (i.e., the volume) of the second cavity 72 is adjustable. That is, the additional pressurized oil bears against the face 60*b* of the piston 58, urging the piston 58 and the attached piston rod 38 toward the end cap 58. The position of the piston 64 relative to the end cap 52 remains essentially the same due to residual pressure on the cavity 74, or due to an optional mechanical stop (not shown). The aperture 66 permits free movement of the piston 64. As the piston 58 and the piston rod 38 are forced toward the end cap 50, the effective length of the hydraulic cylinder is changed, thus altering (e.g., increasing) the size of the gap 26.

In a similar manner, the size of the adjustable second cavity 72 may be decreased by opening the valve 98*a*, which permits a quantity of hydraulic oil in the second cavity 72 to exit via the port 84, flow through the bore 80, and exit the port 82. The oil may be routed to a suitable drain or reservoir. When this happens, the volume within the second cavity 72 decreases and the piston 58 and the piston rod 38 shift toward the lower left when viewing the Figs. and away from the end cap 50. Thus, the effective length of the hydraulic cylinder 32 is lengthened, thus decreasing the size of the gap 26.

A suitable control system of the type commonly employed in the art may be provided in order to facilitate the selective activation of the valves 98*a*, 98*b*, and the pump 100, all of which would be within the ability of one of ordinary skill in the art. Accordingly, when operated in accordance with the disclosed example, the affective length of the hydraulic cylinder 32 may be altered by pumping hydraulic oil into or out of the adjustable second cavity 72 in the manner described above. As the position of the piston rod 38 changes, the position of the lower portion 14 of the movable jaw 24 changes with respect to the lower portion 22 of the stationary jaw 12, thus changing the size of the gap 26. Further, it will be understood that the adjustment of the gap 26 as described above may be carried out during the operation of the jaw crusher 10.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A jaw crusher, comprising:

a frame;

a stationary jaw;

a moveable jaw, the moveable jaw shiftably mounted to the frame and being moveable toward and away from the stationary jaw, the stationary jaw and the movable jaw defining a crushing chamber there between; and a tramp iron relief system operatively connecting a portion of the moveable jaw to the frame, the tramp iron relief system comprising:

a hydraulic cylinder, the hydraulic cylinder in operative communication with an oil supply;

a rod, the rod including a first end disposed within the cylinder and a second end operatively connected to the moveable jaw;

a first piston disposed within the cylinder and fixed to the rod adjacent the first end of the rod;

a second piston disposed within the cylinder and shiftably mounted to the rod, the first piston and the second piston cooperating to define an adjustable cavity there between; and the rod including a bore, the bore having a first bore disposed within the adjustable cavity and a second bore disposed adjacent the second end of the rod, the bore arranged to communicate oil from the oil source into and out of the adjustable cavity.

2. The jaw crusher of claim 1, wherein the second piston includes a central aperture sized to receive the rod.

3. The jaw crusher of claim 1, wherein the tramp iron relief system includes a position sensor.

4. The jaw crusher of claim 1, including a position sensor comprising a linear variable differential transformer, and wherein the rod includes a longitudinal groove sized to receive the position sensor.

5. The jaw crusher of claim 1, wherein the oil supply includes an accumulator and a reservoir, the accumulator in flow communication with a first end of the hydraulic cylinder, the reservoir in flow communication with a second end of the hydraulic cylinder.

6. The jaw crusher of claim 5, wherein the oil supply includes a plurality of valves and a pump, the pump and at least one of the valves arranged to communicate into and out of the adjustable cavity.

7. The jaw crusher of claim 6, including a controller arranged to control each of the plurality of valves and the pump.

8. A jaw crusher, comprising:

a frame;

a stationary jaw;

a moveable jaw, the moveable jaw shiftably mounted to the frame and being moveable toward and away from the stationary jaw, the stationary jaw and the movable jaw defining a crushing chamber there between; and a tramp iron relief system, the tramp iron relief system including:

a hydraulic cylinder;

a first piston reciprocally disposed within the cylinder;

a piston rod having a first end secured to the first piston and having a second end operatively engaging the moveable jaw;

a second piston slidably mounted to the rod;

the hydraulic cylinder and the first and second pistons cooperating to define a first cavity, a second cavity, and a third cavity, the second cavity defined between the first piston and the second piston; and a hydraulic system arranged to route hydraulic fluid into and out of the second cavity.

9. The jaw crusher of claim 8, wherein the first cavity is in flow communication with an accumulator and the third cavity is in flow communication with a reservoir.

10. The jaw crusher of claim 8, wherein the first cavity is in flow communication with an accumulator, the accumulator arranged to receive hydraulic fluid from the first cavity in response to a tramp iron event, and wherein the third cavity is in flow communication with a reservoir, the reservoir arranged to supply hydraulic fluid to the third cavity in response to a tramp iron event.

11. The jaw crusher of claim 10, wherein the accumulator is connected to the first cavity via a first line, and further wherein the accumulator is arranged to maintain the first cavity under pressure.

12. The jaw crusher of claim 8, a portion of the fixed jaw and a portion of the moveable jaw define a gap there between, and wherein the tramp iron relief system includes a position sensor, the position sensor arranged to provide an output indicative of the size of the gap.

13. The jaw crusher of claim 12, wherein the position sensor comprises a linear variable differential transformer, and wherein the rod includes a longitudinal groove sized to receive a portion of the position sensor.

14. The jaw crusher of claim 8, wherein the hydraulic system includes a pair of valves and a pump, the pump and the pair of valves arranged to selectively communicate hydraulic fluid into and out of the second cavity, thereby increasing and decreasing, respectively, the size of the second cavity.

15. The jaw crusher of claim 14, including a controller arranged to control each of the pair of valves and the pump.

16. A jaw crusher, comprising:

a frame;

a stationary jaw;

a moveable jaw, the moveable jaw shiftably mounted to the frame and being moveable toward and away from the stationary jaw, the stationary jaw and the movable jaw defining a crushing chamber there between, a lower portion of the moveable jaw cooperating with a lower portion of the stationary jaw to define a closed side setting gap; and a hydraulic tramp iron relief system operatively connecting the moveable jaw to the frame, the tramp iron relief system arranged to permit uncrushable material to pass through the crushing chamber by permitting the lower portion of the jaw to shift to a shifted position in which the gap is increased;

the tramp iron relief system including an adjustable hydraulic cylinder having fixed ends caps and filled with hydraulic fluid, the adjustable hydraulic cylinder having an end responsive to movement of the lower portion of the jaw and having a first effective length and a second effective length, the first effective length permitting the end to move a first distance and the second effective length permitting the end to move only up to a second distance less than the first distance, the adjustable hydraulic cylinder including a rod, a fixed piston affixed to the rod and a sliding piston slidably mounted to the rod, the rod including a port for communicating oil to an adjustable cavity defined between the fixed piston and the sliding piston, the cylinder further including a port arranged to communicate oil into or out of the hydraulic cylinder to move the fixed piston in conjunction with the sliding piston, the adjustable hydraulic cylinder arranged to permit the gap to be adjusted during operation of the crusher.

17. The jaw crusher of claim 16, wherein the hydraulic tramp iron relief system includes an accumulator and a reservoir.

18. The jaw crusher of claim 17, wherein the accumulator is arranged to receive hydraulic oil from the hydraulic cylinder during a tramp iron event, and wherein the reservoir is arranged to supply hydraulic oil to the cylinder during a tramp iron event, and further including a pump and at least one valve arranged to supply hydraulic oil to the adjustable cavity and arranged to change the effective length.

19. The jaw crusher of claim 17, wherein the hydraulic cylinder includes a first cavity, and wherein the accumulator is connected to the first cavity of the hydraulic cylinder via a first line, and further wherein the accumulator is arranged to maintain the first cavity under pressure.

20. A jaw crusher, comprising:

a frame;

a stationary jaw;

a moveable jaw, the moveable jaw shiftably mounted to the frame and being moveable toward and away from the stationary jaw, the stationary jaw and the movable jaw defining a crushing chamber there between, a lower portion of the moveable jaw cooperating with a lower portion of the stationary jaw to define a closed side setting gap; and a hydraulic tramp iron relief system operatively connecting the moveable jaw to the frame, the tramp iron relief system arranged to permit uncrushable material to pass through the crushing chamber by permitting the lower portion of the jaw to shift to a shifted position in which the gap is increased;

the tramp iron relief system including an adjustable hydraulic cylinder, the hydraulic cylinder arranged to permit the gap to be adjusted during operation of the crusher, and further wherein the tramp iron relief system includes a position sensor, the position sensor arranged to provide an output indicative of the size of the gap.

21. The jaw crusher of claim 20, wherein the hydraulic cylinder includes a rod, and wherein the position sensor comprises a linear variable differential transformer operatively connected to the rod.

22. The jaw crusher of claim 18, including a controller arranged to control the valve and the pump.

23. A jaw crusher, comprising:

a frame;

a stationary jaw;

a moveable jaw, the moveable jaw shiftably mounted to the frame and being moveable toward and away from the stationary jaw, the stationary jaw and the movable jaw defining a crushing chamber there between, a lower portion of the moveable jaw cooperating with a lower portion of the stationary jaw to define a closed side setting gap; and a hydraulic tramp iron relief system operatively connecting the moveable jaw to the frame, the tramp iron relief system arranged to permit uncrushable material to pass through the crushing chamber by permitting the lower portion of the jaw to shift to a shifted position in which the gap is increased;

the tramp iron relief system including an adjustable hydraulic cylinder, the hydraulic cylinder arranged to permit the gap to be adjusted during operation of the crusher, and further wherein the adjustable hydraulic cylinder includes a piston rod, a fixed piston attached to a first end of the rod, and a second piston shiftably attached to the rod, the first and second pistons defining therebetween an adjustable cavity.

24. A jaw crusher, comprising:

a frame;

a pair of jaws, the jaws being moveable relative to each other and cooperating to define a crushing chamber, each of the jaws including a lower portion, the lower portions cooperating to define a closed side setting gap;

a tramp iron relief system shiftably connecting the lower portion of a first one of the jaws to the frame, the tramp iron relief system arranged to permit uncrushable material to pass through the crushing chamber by permitting the lower portion of the first jaw to shift from an initial position to a shifted position in which the gap is increased, the tramp iron relief system further arranged to return the lower portion of the first jaw to the initial position; and the tramp iron relief system including a hydraulic cylinder assembly operatively connecting the lower portion of the first jaw to the frame, the hydraulic cylinder assembly having an adjustable effective length, the hydraulic cylinder assembly including a piston rod, a first piston fixed relative to the piston rod and a second piston slidably mounted to the piston rod, the hydraulic cylinder assembly arranged to permit the size of the gap to be adjusted during operation of the crusher.

25. A jaw crusher, comprising:

a frame;

a pair of jaws, the jaws being moveable relative to each other and cooperating to define a crushing chamber, each of the jaws including a lower portion, the lower portions cooperating to define a closed side setting gap;

a tramp iron relief system shiftably connecting the lower portion of a first one of the jaws to the frame, the tramp iron relief system arranged to permit uncrushable material to pass through the crushing chamber by permitting the lower portion of the first jaw to shift from an initial position to a shifted position in which the gap is increased, the tramp iron relief system further arranged to return the lower portion of the first jaw to the initial position;

means for permitting hydraulic adjustment of the gap during operation of the jaw crusher, the means defined at least in part by a pair of pistons bounding an adjustable cavity, at least one of the pistons slidably mounted to a piston rod.

26. The jaw crusher of claim 25, wherein the means comprises a first attachment point on the frame, a second attachment point on the lower portion of the first jaw, and a rod operatively interconnecting the first and second attachment points, the rod defining an effective length, the means arranged to permit hydraulic adjustment of the effective length during operation of the jaw crusher.

27. The jaw crusher of claim 26, the means further comprising an adjustable hydraulic cavity, and including at least one valve and a pump, the effective length of the rod adjustable in response to selectively pumping oil into or out of the adjustable hydraulic cavity.

28. The jaw crusher of claim 27, including an oil accumulator arranged to receive oil from the tramp iron relief system as the first jaw shifts toward the shifted position, and further including a reservoir arranged to supply oil to the tramp iron relief system as the first jaw shifts toward the shifted position.

29. A method of operating a jaw crusher having a frame, and a pair of jaws defining a crushing chamber having a closed side setting gap, the method comprising the steps of:

mounting the jaws to the frame;

providing a tramp iron relief system engaging a lower portion of one of the jaws, the tramp iron relief system arranged to permit the one jaw to shift in response to uncrushable material entering the crushing chamber and to return to an unshifted position upon the uncrushable material exiting the crushing chamber;

providing the tramp iron relief system with a hydraulically adjustable cylinder having a fixed piston and a slidable piston mounted to a piston rod and defining an adjustable cavity therebetween;

operating the jaw crusher; and then adjusting the gap by adjusting the adjustable cavity.

* * * * *